US006814006B2

(12) United States Patent
Johansson

(10) Patent No.: US 6,814,006 B2
(45) Date of Patent: Nov. 9, 2004

(54) SUB-CALIBRE PROJECTILE AND METHOD OF MAKING SUCH A PROJECTILE

(76) Inventor: Bertil Johansson, S-439 30, Onsala (SE)

( * ) Notice: Subject to any disclaimer, the term of this patent is extended or adjusted under 35 U.S.C. 154(b) by 0 days.

(21) Appl. No.: 10/261,004

(22) Filed: Sep. 30, 2002

(65) Prior Publication Data

US 2003/0167958 A1 Sep. 11, 2003

Related U.S. Application Data

(63) Continuation of application No. PCT/SE01/00701, filed on Mar. 30, 2001.

(30) Foreign Application Priority Data

Mar. 30, 2000 (SE) ..... 0001162

(51) Int. Cl.[7] ..... F42B 14/06
(52) U.S. Cl. ..... 102/522
(58) Field of Search ..... 102/522

(56) References Cited

U.S. PATENT DOCUMENTS 2,306,140 A * 12/1942 Reed ..... 102/522
2,386,054 A * 10/1945 McGee ..... 244/3.1
2,983,224 A * 5/1961 Prosen et al. ..... 102/522
3,005,408 A * 10/1961 Prosen et al. ..... 102/522
3,164,092 A * 1/1965 Reed et al. ..... 102/522
3,726,231 A * 4/1973 Kelly et al. ..... 102/522
4,239,006 A * 12/1980 Kelson ..... 102/522
4,488,491 A * 12/1984 Rhodes ..... 102/522
4,726,298 A * 2/1988 Sigg et al. ..... 102/523
4,800,816 A * 1/1989 Meyer ..... 102/523
4,970,960 A 11/1990 Feldmann
5,175,394 A 12/1992 Sowash
5,339,743 A 8/1994 Scarlata
5,479,861 A * 1/1996 Kinchin ..... 102/439
6,073,560 A * 6/2000 Stone ..... 102/522

FOREIGN PATENT DOCUMENTS

| | | |
|---|---|---|
| DE | 700065 | 12/1940 |
| DE | 2321950 | 5/1973 |
| SE | 7003219-8 | 3/1975 |

* cited by examiner

*Primary Examiner*—Charles T. Jordan
*Assistant Examiner*—Bret Hayes
(74) *Attorney, Agent, or Firm*—Gauthier & Connors, LLP

(57) ABSTRACT

The present invention relates to a composed projectile for subcalibre projectile comprising a sabot, a projectile and a driving speculum, whereby said composed projectile comprises a projectile made of a metal material, preferably having a high density, and that the length of the composed projectile is not substantially longer than the projectile, as well as a cartridge comprising such a composed projectile.

17 Claims, 5 Drawing Sheets

SUB-CALIBRE PROJECTILE AND METHOD OF MAKING SUCH A PROJECTILE

This is a continuation of copending application(s). International Application PCT/SE01/00701 filed on 30 Mar. 2001 and which designated the U.S.

TECHNICAL FIELD

The present invention relates to a composed projectile for subcalibre, in particular fine calibre ammuniton, comprising a sabot, a projectile and a driving speculum which, when present in an ammunition is suitable for firearms such as personal defence weapons (PDW), such as pistols, machine guns, but also automatic weapons of carbine type, as well as light support weapons. Further, the invention relates to a cartridge containing such a composed projectile, process for the manufacture of such a composed projectile, as well as projectile.

The object of the present invention is to obtain a composed projectile to be used preferably in a subcalibre ammunition of firearms and lighter offensive weapons, which ammunition meets great demands on performance with regard to penetration ability, range of fire and efficacy in the target.

Further objects are to meet environmental demands such as lowest possible discharge of toxic heavy metals, lowest possible weight, and possibility to use such ammunition without substantial changes of weapon systems in present firearms such as machine guns, pistols, automatic carbines and light support weapons.

BACKGROUND OF THE INVENTION

The technical problem today is to obtain a projectile which provides a high penetration ability and this can i.a., be achieved by having a high outlet speed and with high maintained speed in the trajectory as well as a high speed in the target, preferably over a large distance. Such demands can be met only mainly by a projectile having high load, i.e., large mass per cross sectional area.

The demands have thus been to obtain an ammunition which can replace 9 mm parabellum ammunition and similar short ammunition types with the ammunition having high load in spite of short length, i.e., high weight per cross sectional area in the moving direction, high penetration ability, high impact energy in the target; short trajectory times with a fiat trajectory, and preferably, a high projectile speed in the target.

Standard ammunition is a type of ammunition, which is used by several weapons in a military unit. Today a military fighting unit uses a number of ammunition types due to the use of different types of weapons, such as pistols, machine guns, sniper weapons, light support weapons and automatic carbines, whereby 9 ram, 5.56 mm, and 7.62 mm ammunition types are available. If one can solve the technical problem discussed herein with standard ammunition, it would be highly desirable. From a logistic point of view one should have as few types of ammunition as possible and a desire is thereby to have as few ammunition types as possible to distribute to different units. If it would be possible to have the same ammunition in the pistol, which is carried by staff personal as in the automatic carbine, which is worn by soldiers in the front lines of the fighting unit, much would have been accomplished.

The 9 mm ammunition has been use for a long time and in particular to matching guns and pistols which are so called firearms of the type called personal defiance weapons (PDW×Personal Defense Weapon).

The drawback with 9-mm ammunition is that it has only a working range, which is about 200 m whereupon the spreading and ballistics make hits less sure. Due to the soft core of the projectile, large cross sectional area and low impact energy a 9-mm projectile will not pass through modern body shields. The lack of penetration ability provides for the fact that the projectile does not penetrate a modern body shield even after the weapon muzzle.

The present sabot bound projectiles for firearms, of the types mentioned above, have not been able to meet these great demands raised on ballistics and accuracy in firing due to different factor such a lack of support of the projectile by the sabot, and a inferior balance in the trajectory due to deficient separation between projectile and sabot.

U.S. Pat. No. 5,175,394 describes an arrangement for a low pressure cartridge—shot gun cartridge with about 80 MPa—where the pressure graph rapidly decreases and where the density of the projectile is not intended to exceed 11.4 (the density of lead). Further, no rotation is transferred to the projectile from the smooth bore. In order to be able to transfer acceleration from a sabot to a projectile this must have a very particular form having a pronounced waist where the sabot will obtain enough large attack-surface against the projectile. This specific design of the projectile has nothing in common to the present invention where completely different demands are made on the composed projectile, i.e. sabot and projectile.

EP-A-0 375 312 relates to a very ambitious construction what regard the application of fine calibre but does, in no way fulfil the requirement of minimal elongation besides the projectile of its own length. There is only an isolated term—high-density metal—from a sentence that has resemblance whatsoever with the present invention.

U.S. Pat. No. 4,653,404 relates to a construction, which requires a relatively thick bottom/supporting disc of the sabot behind the projectile. The contact area of the sabot against the projectile is restricted to the cylindrical jacket surface which, moreover, is broken by the splitting indents. This leads to an unprotected projectile point, which moreover creates a feeding problem in automatically charged weapons. Further the risk of projectile oscillation in the barrel having this short guidance, which can give troublesome effects not only on the trajectory, but also on the barrel. This is well known problem in the circuit of people skilled in the art using this construction with regard to the splitting of the sectors, which supposes that the material breaks completely symmetrically in order not to disturb the projectile at the separation. The latter is not the least important at strongly shifting temperature conditions. The supporting disc has to be applied already at the moulding of the sabot, which apparently makes the product more expensive and reduces production capacity.

U.S. Pat. No. 5,339,743 is apparently intended for a low-pressure system such as a shotgun. However, it is stated on unknown grounds, that the sabot with its projectile requires and obtains a rotation transferred from the barrel. In col. 2, line 17 it is stated the "copper slug" whereby thus it is said that the material of the projectile is copper having a substantially lower density than the preferred projectile of the present invention. A further aid to help the sabot to withstand the gas pressure is the two elements being placed between the driving charge and the sabot. Such aids are not necessary at the present invention, which further reduces the cost in connection with the production, furthermore it prolongs the projectile.

DESCRIPTION OF THE PRESENT INVENTION

It has now surprisingly turned out possible to be able to solve this problem by means of the present invention which is characterized in that the cartridge comprises a projectile made of a metallic material, preferably of high density, and that the length of the composed projectile does not substantially exceeds the length of the projectile.

Further characteristics are evident from the accompanying claims.

By means of the present invention shorter projectiles can be obtained which in the end can make it possible to create a more compact, shorter cartridge which in turn can lead to a more compact, lighter weapon.

By means of the present invention the use of high density metal materials in a projectile of a cartridge is made possible which projectile seen from a load point of view at comparable normal values has a form which is better than the basic form, has a $V_0$, i.e., speed at the muzzle which exceeds the speed of said type of ammunition, has a $V_{400}$ which exceeds the one of said ammunition type, has a $E_0$, i.e., hitting energy at the muzzle which exceeds the one of said ammunition type, and a $E_{400}$ which exceeds the one of said ammunition type as well. By means of the invention one can fire projectiles having a high density which maintains speed and energy. The high-density favours reduced speed reduction.

The invention will be described more in detail in the following with reference to the accompanying drawing, which shows a preferred embodiment, however, without being restricted thereto.

Figure 1:
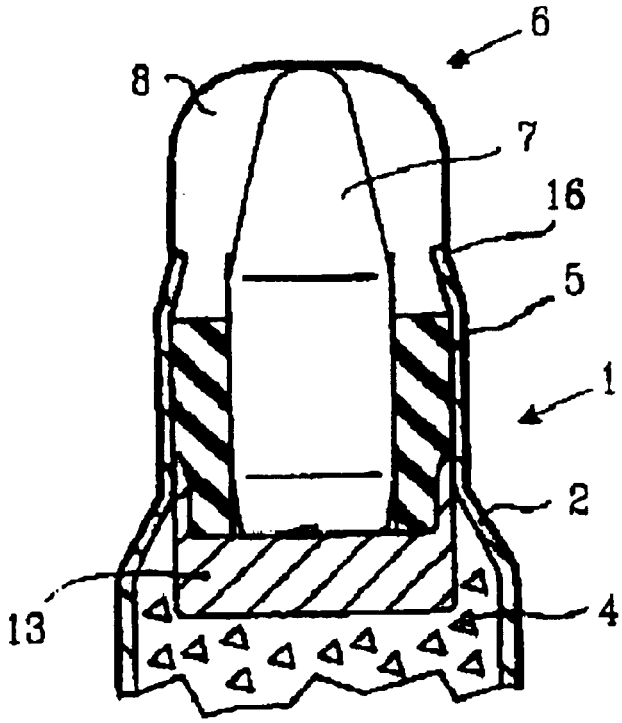
FIG. 1 shows a cross-section along the longitudinal axis of the upper part of a cartridge having a composed projectile in accordance with the present invention.
Figure 2:
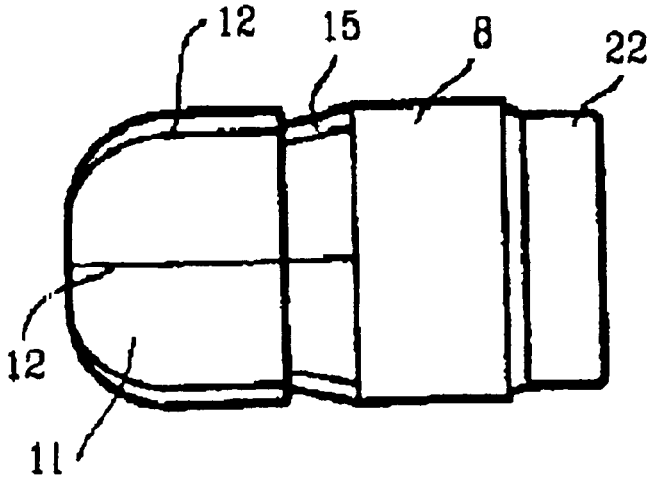
FIG. 2 shows a side view of a sabot used in a composed projectile in accordance with the present invention.
Figure 3:
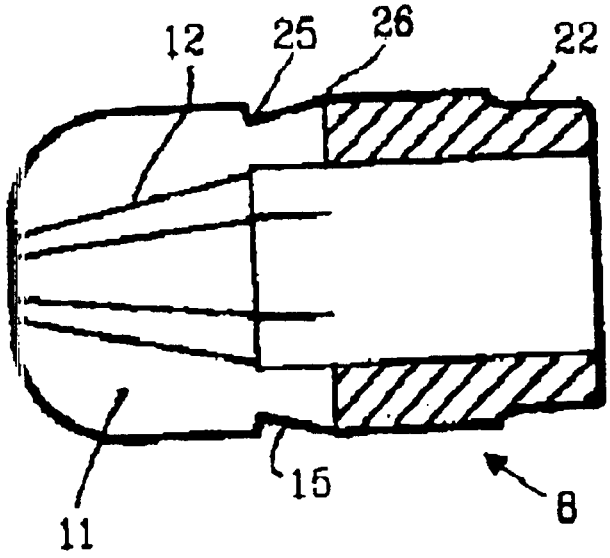
FIG. 3 shows a sabot according to FIG. 2 in a cross-section along its longitudinal axis.
Figure 4:
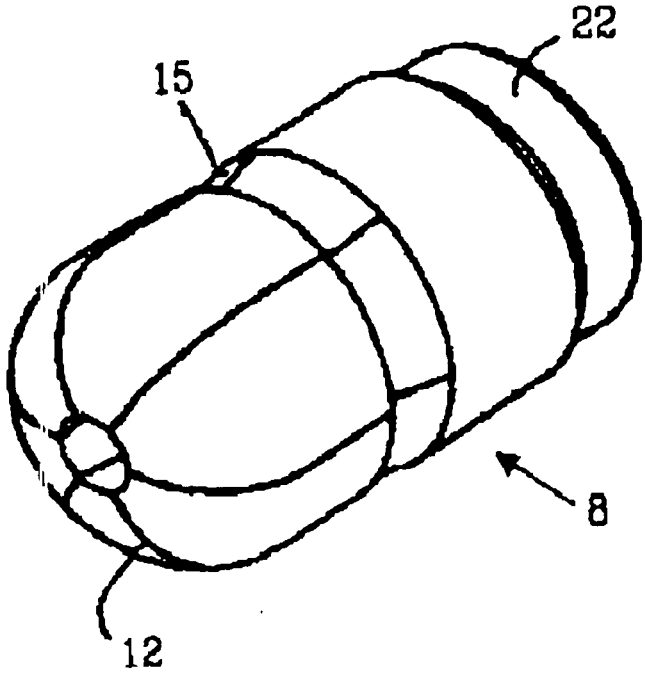
FIG. 4 shows a sabot according to FIG. 2 in a perspective view.
Figure 5:
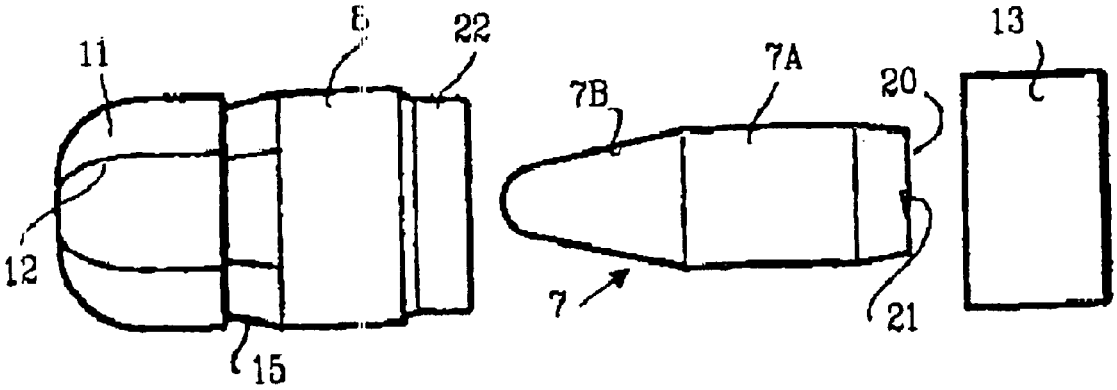
FIG. 5 shows a side view of the parts of a composed projectile.
Figure 6:
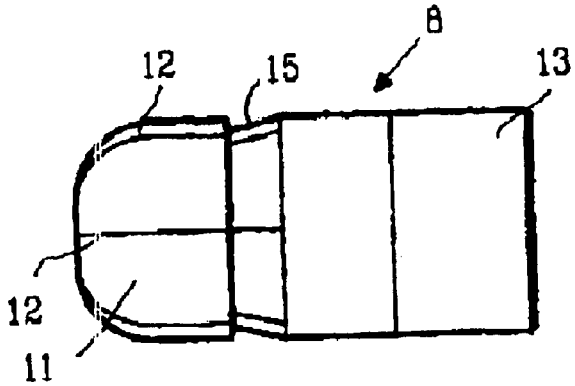
FIG. 6 shows a side view of a composed projectile according to the invention.
Figure 7:
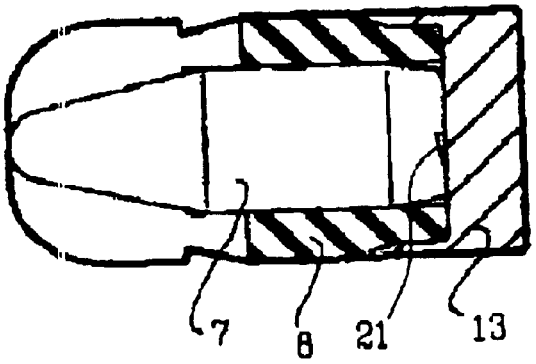
FIG. 7 shows the composed projectile according to FIG. 6 in a cross-section along its longitudinal axis.
Figure 8:
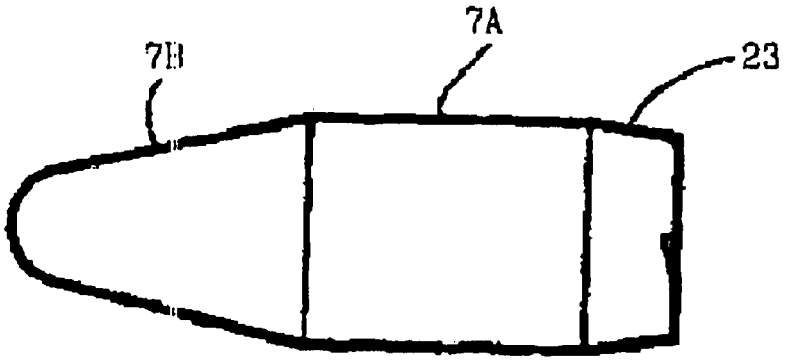
FIG. 8 shows a side view of the projectile according to the invention.
Figure 9:
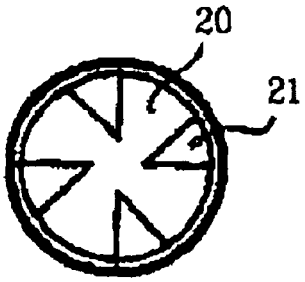
FIG. 9 shows a view from behind of the projectile according to FIG. 8.
Figure 10:
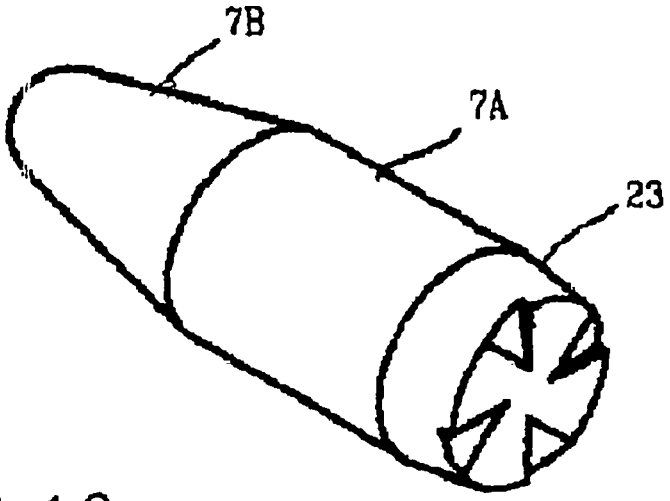
FIG. 10 shows a perspective view at an angle from behind of the projectile according to FIG. 8.
Figure 12:
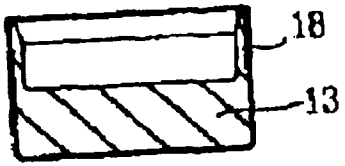
FIG. 12 shows the driving speculum according to FIG. 11 seen in a perspective view from above.
Figure 11:
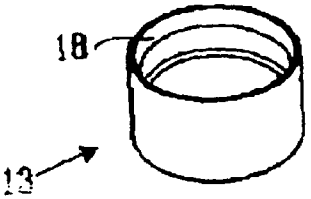
FIG. 11 shows a driving speculum contained in the composed projectile in a cross-section through its longitudinal axis.
Figure 13:
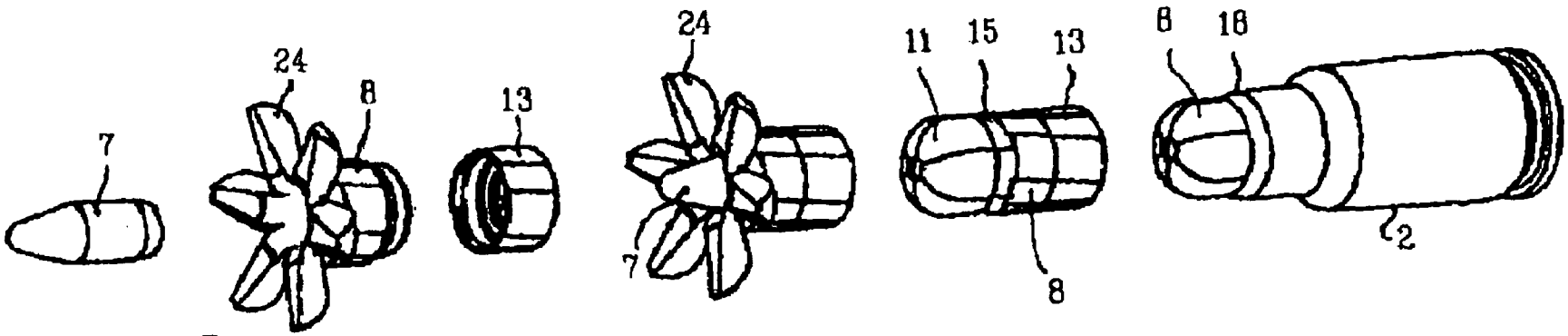
FIG. 13 a composed projectile with its casing during a firing event.

The element 1 denotes in general a cartridge comprising a casing 2 made of e.g., aluminum which casing in the present embodiment, has a push bottom with the same diameter that corresponds to a 9-mm parabellum (9×19 ram). The casing 2 receives in its bottom part a percussion cap of a conventional type (not shown), which percussion cap at a hit is intended to fire an amount of powder 4 placed in the inner space of the casing 2. The casing 2 has, in its upper part, a neck 5 that is compressed with a shrinkage 16 to receive a composed projectile 6 having a diameter of 6.5 ram. The casing 2 further has an extractor slot (not shown) adapted to conventional extractors.

The composed projectile 6 comprises a projectile 7, a sabot 8 and a driving speculum 13 arranged to the lower end of the sabot 8. As mentioned the composed projectile 6 comprises on one hand a projectile 7, and on the other hand a sabot 8. The projectile 7 is substantially designed pointed with material, preferably a high-density material, such as a wolfram alloy having a density of 17.5 g/cm$^3$. It shall, however, be noted that also other, more conventional materials, such as lead, iron, depleted uranium, brass jacketed lead core, and other metals can be used as a projectile 7. In the actual example the projectile 7 has a diameter of 4.0 mm. The projectile comprises two main parts, viz, a rear part 7A, which is cylindrically designed, and a front part 7B, which is conical or ogivally designed. The task of the front part 7B is to control the projectile and to prevent wobbling thereof in the barrel and the trajectory. The main parts 7A and 7B have about the same length, i.e., each comprising half the length of the projectile 7. The rear-facing end 20 of the rear part 7A has a number of recesses 21 to the formation of slot containing end surface or cross or star formed end surface. The pattern of this rearward facing end surface is not restricted to such forms as given but may comprise any frictional pattern which can be brought into encroachment with a driving speculum in accordance with below. The projectile 7 is totally or substantially totally enclosed by a sabot 8. Between the top or front end 11 of the sabot and down along the jacket of the sabot 8 in level with or shortly below half the length of the core projectile incisions 12, which are through-going, through-cutting, preferably radially directed, in such a way that the upper part of the sabot 8 between the top 11 is divided into suitably four to eight, materially separated sectors 24. The through-going incisions 12 are made with minimal reduction of material and preferably no material reduction at all so that the sabot 8 can enclose the projectile 7 to a maximum and prevent leakage into the inner of the cartridge 1 of e.g., any moisture. The sectors support each other symmetrically and prevent any asymmetrical overlapping/abutment. The front part 11 of the sabot 8 is well drawn out to the formation of shoulders. This means that the sabot has got an almost cylindrical form, which guides well in the barrel, and guides the front end of the projectile. The lower part of the sabot 8 with its projectile 7 receives a driving speculum 13 which restricts the sabot/projectile 8, 7 from the charge of powder 4. It is hereby of importance that the driving speculum 13 is an integrated part of-the composed projectile 6, that the driving speculum 13 is a pressure surface for the charge of powder, that the driving speculum 13 tightens through the bore of the weapon so that the disintegration of the sabot 8 does not start within the bore. The driving speculum 13 which is made of metal such as aluminum has a thickness which is enough to withstand the pressure forces existing between projectile and driving speculum during a firing event and can be some to a few millimeters, has a cylindrical collar 18 being arranged above a indented cylindrical lower part 22 of the sabot to the formation of an integrated part of the sabot 8. The core projectile 7 is preferably indented/lightly conical ended in the area closest to the sabot 8/driving speculum 13 to admit a non-influenced separation of sabot and core projectile. The conic degree 23 means that the sabot at the movement of the composed projectile through a barrel is not pressed to a too thigh abutment against the rear end of the projectile by means of the bars of the barrel. The sabot is embossed by the bars but as the material is elastic the grip of the sabot on the projectile ceases at the muzzle. The driving speculum being of metal is, however, permanently embossed why its grip via the sabot remains intact and thus the release by means of the conic degree or in any other way is of value to obtain a good release of the projectile. The corresponding can be obtained as the sabot is made conical diverging rearward at its inside. The conic degree means the core projectile has an end diameter, which is some to a few tens of a millimeters less than the diameter of the cylindrical part of the core projectile.

The projectile 7 has preferably a density which exceeds the density of lead, suitably exceeding 12 $g/cm_3$, preferably exceeding 15 $g/cm^3$ and is more preferably as mentioned, made of a wolfram alloy having a density of 17.5 $g/cm^3$.

A sabot 8 allows for a large attack surface on the composed projectile in the bore/barrel but gives a small attack surface in the trajectory as the sabot is released in the muzzle. Therefore the barrel of a weapon can be made shorter as one still obtains a high $V_0$. Another advantage having a sabot is that one can obtain a projectile, which has no direct geometrical binding to the barrel but can have other forms which are optimal to other purposes. For example the proportions between conic and cylindrical form unessential in the present invention with regard to the barrel situation ad one obtains a larger freedom to create an optimal projectile.

The sabot 8 is provided with a peripherally, radially extending shrink indentation 15, which shrink indentation 15 is in encroachment with the indented forward edge of the casing, the shrinkage 16. The through-going cuts 12 also have such a length that they pass up to and including this peripherally running shrink indentation 15. Hereby the cuts 12 run so far down along the sabot 8 that they connect to the cylindrical part of a projectile being received in the sabot for the intention to maximize the release of sabot/projectile from each other at the foldout after the muzzle of a barrel. The material thinning of the shrink indentation hereby secures an exact, predetermined foldout of the front part of the sabot after exit of the bore. The front sectors of the sabot 8 support each other simultaneously as they orient symmetrically to each other and thereby avoid asymmetric support of the projectile.

At the shrink indentation 15 there are two peripheral lines defined as well, viz., a first line 25 which is the deepest part of the shrink indentation 15 and where the sabot has its largest material thinning and around which a foldout of the sabot will take place, and a second peripheral line 26 to which the cuts 12 extend. This second line coincides with the restriction line of the shrink indentation itself.

The sabot 8 is attached in a casing by means of contraction whereby the contraction between the shrink indentation 15 and the shrinkage 16 of the casing is made in such a way that there is created a suitable resistance for releasing the composed projectile from the casing which guarantees an even and balanced pressure building from shot to shot. The contraction will prior to firing keep the sectors of the front part 11 of the sabot together, as well.

In another embodiment the lower part of the sabot 8 can be provided with a bulge and a track which match an inwardly radially directed bulge provided in the collar 18 of the driving speculum 13, whereby the track receives said bulge. Hereby it is obtained a tight joint between the sabot 8 and its driving speculum 13 as well, so that no powder gases will pass between the projectile and the sabot.

The composed projectile, and then essentially the sabot 8, has such a design that the composed projectile has a substantially cylindrical form which is achieved by means of the fact the shoulders, front part 11, of the sabot 8 is drawn out. Hereby a maximal guiding and transfer or rotation is obtained in a bore provided with bars, and thereby in the future the stability of the projectile in its trajectory. Further, the form increases the presumption to transfer rotation to the projectile as the contact surfaces are maximal between sabot and projectile, which is also decisive for the rotation the projectile will obtain in its trajectory. The form with drawn out shoulders gives a mass accumulation, which is high and thereby provides for a high centrifugal force for the foldout of the sabot. This geometry secures a feeding in magazine and cartridge sliding chute as well.

The sabot 8 is suitably made of a polyamide or a polyolefin, such as polyethylene HD or polypropylene by means of conventional polymer forming technique. One requirement hereby is that the polymer is tough and strong. The requirement is basically that the sabot shall open efficiently along a radial jacket line, the first peripheral line 25, in or in direct connection to the peripheral shrink indentation 15, down to the second peripheral line 26, and that the sabot 8 keeps together after foldout so that no sector is released and continues in an uncontrollable way. After the muzzle a foldout sabot falls quickly to the ground on one hand due to the braking effect as provided by the foldout sectors, on the other hand by the low content of kinetic energy of the sabot as such. Asymmetric opening of the sabot shall be avoided as this can lead to the fact that the projectile after having left the sabot obtains a wobbling in the trajectory. Further the sabot 8 shall be completely tightening in the barrel of the weapon from which a cartridge containing the composed projectile is fired and has a substantially closed front end 11 outward-forward.

At firing of the present cartridge t at first a pressure wilt be built up in the casing before the composed projectile is released from the shrink indentation by means of the gas pressure on the driving speculum. When the composed projectile is going to move forward the first event is that the driving speculum is pressed against the rear end of the projectile and is thereby embossed by this to a frictional and/or key interference with the projectile. The load is thus transferred to the projectile and sabot to such a degree that the composed projectile is released from the casing. The composed projectile is brought into the bore and wherein at first the sabot is guided by the bars and starts to rotate in a controlled manner by means of the bars. In the moment before the driving speculum reaches, the bars, the projectile, and the driving speculum have not really obtained a rotation and not the same rotation as the sabot. The sabot is hereby on one hand one unit and the projectile and the driving speculum on the other hand one unit seen from a movement point of view. When the driving speculum reaches the bars the guiding of the bars of the driving speculum will be transferred to the projectile as well via said "friction or interference joint" and the rotation in the bore will be completely transferred to the core projectile whereby the whole composed projectile from a rotation and movement point of view will become one unit, whereupon the composed projectile is driven through the bore.

The embossment of the rear end of the projectile into the driving speculum leads to an active cooperation between sabot, projectile, and driving speculum. At the muzzle the sabot is foldout in a controlled manner by division along the cuts 12 down to and inclusive the shrink indentation 15. The function of the sectors is hereby to control the foldout of the sabot 8 to a peripheral line in a symmetric way which minimizes the risk that the foldout of the sectors of the sabot does not take place in a completely symmetric way, which would create a disturbance of the separation phase. The peripheral line 25 is defined, in accordance with above, by the material thinning of the shrink indentation and creates hereby a "hinge" or "hollow of the knee" along the jacket of the sabot. The geometry can thereby suitably be designed in such a way in the shrink indentation when the sectors are completely folded out that their contact surfaces meet under the formation of an angle of about 900 to the longitudinal axis. This also guarantees the equality of the foldout. The sectors are thus folded out in a fan-shaped way and will then be an efficient air brake, which results in the rapid decrease of the rotation of the sabot and forward movement. The sabot is drawn off from the projectile by means of the difference in speed, which projectile continues in its trajectory towards the target. By means of the rotation the separation between sabot and projectile will become gyro-stabilized which results in that the projectile will obtain an extraordinarily stable, continued trajectory without any tendency of wobbling or oscillation.

The projectile 7 is released from the foldout sabot 8 in connection with the muzzle and continues in its own trajectory. By means of the construction of the projectile and the relatively high $V_0$ of the projectile a very flat projectile trajectory will be obtained.

Conclusively, the present invention provides a sabot enclosing a core projectile, which sabot protects and supports this projectile completely, which sabot efficiently separates from the projectile by folding out along a defined line, the shrink encroachment, a driving speculum which actively co-operates with the projectile to transfer rotation to the projectile and the sabot and which closes the sabot and forms a rear tightening, and which, finally, allows the composed projectile to be brought together by introducing the projectile from behind, whereupon the driving speculum is attached from behind.

The invention is useful in most applications but is best utilised in proportionally small/short cartridges when the composed projectile is only slightly longer than the core projectile 7. It will also stand very high gas pressures. The invention is further suited particularly well in conventional cartridges as the point of the projectile can be made pointed.

As a difference from prior art the present invention has a separate metallic driving speculum. Such a solution means to the fact that the strength becomes higher than using a polymer, provides a condition for mounting of the composed projectile from behind, as well as it faces a "patterned" projectile rear end 20 to secure transfer of rotation.

By applying a shrink contraction between the neck of the casing and the shrink encroachment an even and balanced building-up of pressure in the casing at the firing of the powder load which compensates for the relative light projectile and the relatively low friction of the sabot and the driving speculum in the bore.

By adopting the outer-geometry to the geometry of an ordinary 9×19 mm ammunition, as in the example above, the present cartridge can by used in a number of weapons adapted to such ammunition, whereby in the general case there is only a need for changing the barrel from calibre 9 mm to calibre 6.5 mm.

The present composed projectile, i.e., the driving speculum+sabot+projectile can be adapted t present fire arm calibres whereby the composed projectile can vary from 4 to 15 mm and have a projectile calibre of 2 to 12 mm.

By combining the above composed projectile and using aluminium at the production of the casing there is an environmental alternative to use brass where heavy metals can dissolve when the casing is left in the terrain. However, the choice of material is not restricted to aluminium but can be any other suitable casing material such as brass, steel. Aluminium gives, however, a 60% weight reduction and a comparable reduction when it comes to production costs.

By means of an optimal choice of composed projectile and casing according to the example above when producing a cartridge, a soldier can carry up to 4 times as much cartridges of the present invention compared with e.g., a 5.56 mm NATO cartridge, within the requirements of a certain weapon and weight of ammunition.

The present invention is in no way restricted to the above given example but is only restricted by the accompanying claims and the variations as the one skilled in the art being guided thereof can obtain.

What is claimed is:

1. A composed projectile for subcalibre projectile comprising a sabot, a projectile as having a front end and rear end and a driving speculum, wherein the composed projectile has geometry, which is substantially cylindrical, that said composed projectile comprises a projectile made of a metal material, that the length of the composed projectile is not substantially longer than the projectile, that the sabot is arranged to substantially enclose the subcalibre projectile, said projectile also includes a rearward facing end that has a patterned surface to produce a friction and/or interference joint with said driving speculum to support transfer of rotation from movement of the composed projectile through a bore/barrel, the sabot has a front part which is divided into at least four sectors, which sectors are arranged to fold-out a part of the sabot in a controlled manner, an upper part of the sabot is provided with through-going cuts running from the periphery of the sabot and up to a projectile receiving space, which cuts are arranged to run from a front end of the sabot to essentially to a level of a shrink indentation, the sectors of the sabot are arranged to be rapidly fold-out from the geometry of the sabot with a bending direction of said shrink encroachment in a controlled manner, the rear end of the projectile has a rearward conical ending, and that the driving speculum has a substantially cylindrical collar, which is arranged to enclose a corresponding cylindrical contraction at the rear end of the projectile and of the sabot.

2. A composed projectile according claim 1, wherein the projectile at its said rearward facing end comprises one or more recesses which are arranged to cooperate with said driving speculum to support transfer of rotation from the movement of the composed projectile through a bore/barrel.

3. A composed projectile according to claim 1, wherein the sabot has a peripherally running shrink encroachment arranged to receive a contraction of a casing receiving said sabot.

4. A composed projectile according to claim 1, wherein the sabot is designed to be able to be fed in all types of PDWs in the form of pistols, machine guns, or automatic weapons that are in the form of carbine and light support weapons.

5. A composed projectile according to claim 4, wherein the projectile is made of a high-density material.

6. A composed projectile according to claim 5, wherein the density of the metal material is greater than or equal to 17.5 g/cm$^3$.

7. A composed projectile according to claim 5, wherein the projectile has a density of at least 12 g/cm$^3$, preferably at least 15 g/cm$^3$.

8. A composed projectile according to claim 7, wherein the projectile is made of a wolfram alloy having a density of at least 17.5 g/cm$^3$.

9. A cartridge having a subcalibre projectile, wherein comprises a composed projectile in accordance with claim 1.

10. A cartridge according to claim 9, wherein the composed projectile having a caliber of 4 to 15 mm is introduced in a casing.

11. A cartridge according to claim 10, wherein the composed projectile is introduced in a casing of metal.

12. A cartridge according to claim 11, wherein the casing is made of aluminum.

13. A cartridge according to claim 11, wherein the casing is made of brass.

14. A cartridge according to claim 9, wherein the casing and composed projectile are arranged to be able to be fed in all types of weapons.

15. A process for the manufacture of a composed projectile according to claim 1, wherein a projectile is introduced from behind into a sabot whereupon the sabot is sealed by means of a driving speculum.

16. A process according to claim 15, wherein the driving speculum seals the sabot by being thread over the rear end of the sabot.

17. A projectile for subcalibre ammunition and being part of a composed projectile according to claim 1, wherein it comprises a front conical or ogival part and a rear, substantially cylindrical part, wherein the rearward facing surface of the rear part is provided with a patterned surface to provide a friction or key interference with a driving speculum intended to cooperate with the projectile.

* * * * *